US009015906B2

(12) United States Patent
Bartholomew

(10) Patent No.: US 9,015,906 B2
(45) Date of Patent: Apr. 28, 2015

(54) CABLE TIE WITH IMPROVED PAWL

(75) Inventor: Paul John Bartholomew, Somerville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 253 days.

(21) Appl. No.: 13/545,371

(22) Filed: Jul. 10, 2012

(65) Prior Publication Data

US 2013/0031751 A1 Feb. 7, 2013

Related U.S. Application Data

(60) Provisional application No. 61/514,507, filed on Aug. 3, 2011.

(51) Int. Cl.
*B65D 63/16* (2006.01)
*B65D 63/10* (2006.01)

(52) U.S. Cl.
CPC ..... *B65D 63/1045* (2013.01); *B65D 63/1072* (2013.01)

(58) Field of Classification Search
CPC ..... F16L 3/2338; B65D 63/1045; B65D 3/16; B65D 63/1036; B65D 63/1054; B65D 63/14
USPC ... 24/16 PB, 16 R, 17 AP, 30.5 P; 292/307 A
See application file for complete search history.

(56) References Cited

U.S. PATENT DOCUMENTS 1,772,760 A * 8/1930 Rouse ..... 324/115
3,605,199 A 9/1971 Eberhardt
3,660,869 A 5/1972 Caveney et al.
3,875,618 A * 4/1975 Schuplin ..... 24/16 PB
3,952,373 A 4/1976 Noorily
3,965,538 A 6/1976 Caveney et al.
4,135,749 A 1/1979 Caveney et al.
4,272,870 A 6/1981 McCormick
4,498,507 A * 2/1985 Thompson ..... 140/93.2
5,121,524 A 6/1992 Mortensen (Continued)

FOREIGN PATENT DOCUMENTS

EP 1258433 A2 11/2002
WO 01/63159 A2 2/2001

OTHER PUBLICATIONS

Thomas & Betts, Inc. "Why Choose Genuine Ty-Rap Cable Ties?" Ty-Rap Cable Fastening Systems, p. 3.

*Primary Examiner* — Robert J Sandy
*Assistant Examiner* — Michael Lee
(74) *Attorney, Agent, or Firm* — Snyder, Clark, Lesch & Chung, LLP

(57) ABSTRACT

A cable tie includes a band of one material and a pawl of a different material. The pawl has a stem region and a securing region, wherein the securing region includes at least one barb and a stabilizing surface opposite the at least one barb. The band includes a head section and a tail section that may be inserted through the head section to secure a load. The head section includes a base section into which at least a portion of the stem region of the pawl is inserted, and an insertion channel to receive the tail section, wherein at least a portion of the pawl extends into the insertion channel. When a load is exerted to remove the tail section from the insertion channel, the barb engages the tail section and the stabilizing surface contacts a wall of the insertion channel to prevent bending of the pawl.

20 Claims, 6 Drawing Sheets

(56) References Cited

U.S. PATENT DOCUMENTS

| | | | | |
|---|---|---|---|---|
| 5,193,251 | A | 3/1993 | Fortsch | |
| 5,317,787 | A | 6/1994 | Fortsch | |
| 5,513,421 | A | 5/1996 | Wells | |
| 5,517,727 | A | 5/1996 | Bernard et al. | |
| 5,517,728 | A | 5/1996 | Woods | |
| 5,621,949 | A | 4/1997 | Wells et al. | |
| 5,630,252 | A | 5/1997 | Wells | |
| 5,758,390 | A | 6/1998 | Villeneuve | |
| 5,815,891 | A | 10/1998 | Students et al. | |
| 6,076,234 | A | 6/2000 | Khokhar et al. | |
| 6,484,367 | B1 | 11/2002 | Caveney et al. | |
| 6,530,126 | B2 | 3/2003 | Caveney et al. | |
| 6,532,631 | B2 * | 3/2003 | Rohaly et al. | 24/16 PB |
| 6,539,589 | B2 | 4/2003 | Thompson | |
| 6,560,822 | B2 | 5/2003 | Caveney et al. | |
| 6,751,828 | B2 | 6/2004 | Matschiner et al. | |
| 6,807,714 | B2 | 10/2004 | O'Young et al. | |
| 6,863,855 | B2 * | 3/2005 | Shilale | 264/151 |
| 6,928,701 | B2 | 8/2005 | Hutter, III | |
| 7,017,237 | B2 * | 3/2006 | Magno et al. | 24/16 PB |
| 2007/0119030 | A1 * | 5/2007 | Hoffman et al. | 24/16 PB |

* cited by examiner

CABLE TIE WITH IMPROVED PAWL

CROSS-REFERENCE TO RELATED APPLICATION

This application claims priority under 35. U.S.C. §119, based on U.S. Provisional Patent Application No. 61/514,507, filed Aug. 3, 2011, the disclosure of which is hereby incorporated by reference herein.

BACKGROUND INFORMATION

Wiring and cable bundling is an integral part of modern electrical and electronic installations. Cable ties are frequently used to bundle groups of cables as well as secure objects in variety of other non-electrical applications. Generally, a cable tie may encircle a load (such as a cable bundle) so that a tail of the tie is inserted through a head of the tie. When inserted, the tail is secured within the head by a locking mechanism in the head of the cable tie.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Embodiments described herein provide a cable tie with a pawl that provides increased holding force over conventional cable ties. A head of the cable tie may be configured such that a retention load on the pawl (e.g., when an extraction load is placed on a tail of the cable tie that is inserted through the head) is primarily a tensile load, in contrast with a bending load of a conventional pawl configuration.

In one implementation, the cable tie may include a band of one material and a pawl of a different material. The pawl may have a stem region and a securing region, with the securing region including barbs and a stabilizing surface opposite the barbs. The band may include a head section and a tail section that may be inserted through the head section to secure a load. The head section may include a base section into which at least a portion of the stem region of the pawl is inserted and an insertion channel to receive the tail section. At least a portion of the pawl may extend into the insertion channel. When a load is applied to remove the tail section from the insertion channel, the barbs may engage the tail section and the stabilizing surface may contact a wall of the insertion channel to prevent bending of the pawl.

Figure 1:
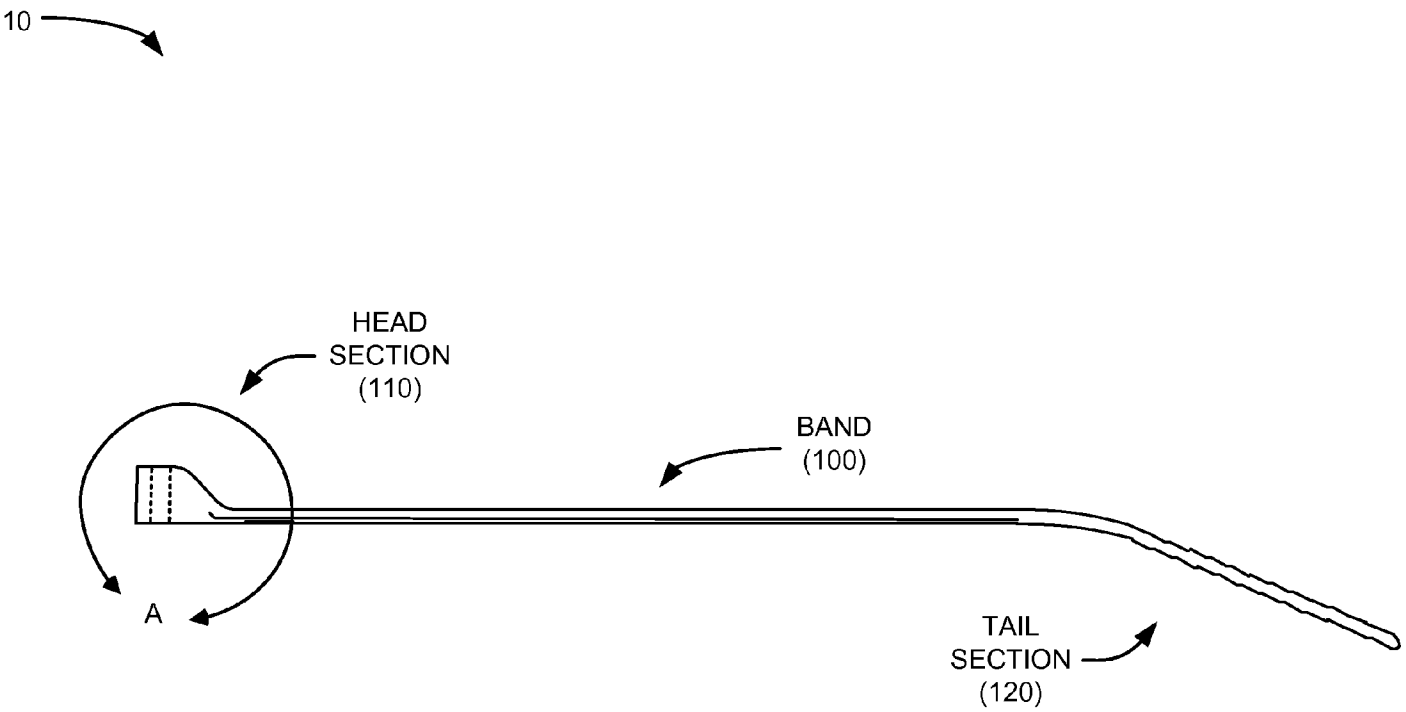
FIG. 1 is a side view of a cable tie according to an implementation described herein.

FIG. 1 is a side view of a cable tie 10 according to an implementation described herein. Referring to FIG. 1, cable tie 10 may include a band 100 having a head section 110 and a tail section 120. Tail section 120 may be inserted through a channel in head section 110 to create a loop that may be used to secure a group of cables and/or other objects. Band 100 may be made of a material with sufficient flexibility to allow tail section 120 to be inserted into head section 110 and sufficient strength to secure objects therein. For example, band 100 may be made of a polymer, such as nylon, polypropylene, polyethylene, or another thermoplastic material.

Figure 2A:
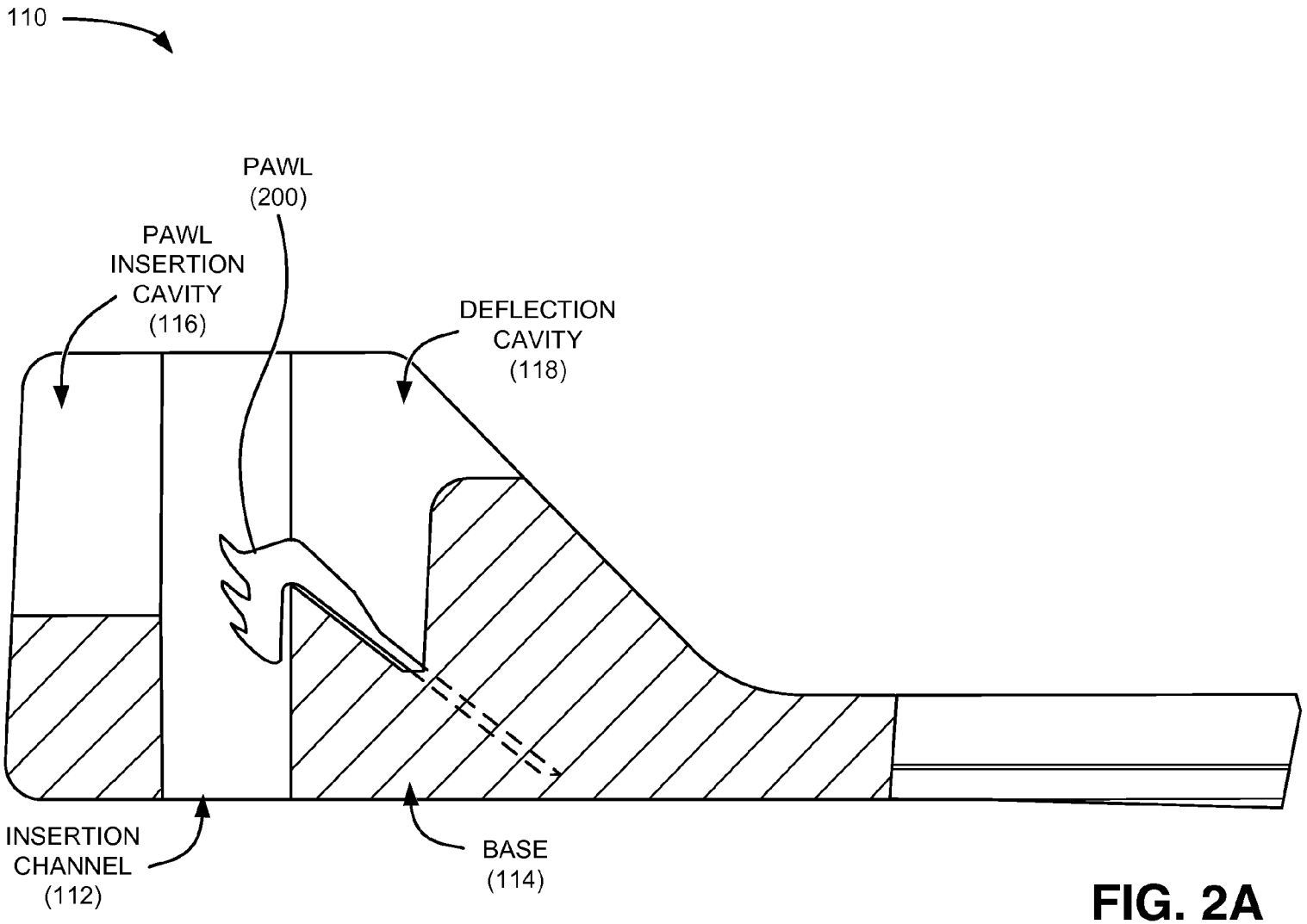
FIG. 2A provides a cross-sectional view of a head section of the cable tie of FIG. 1.
Figure 2B:
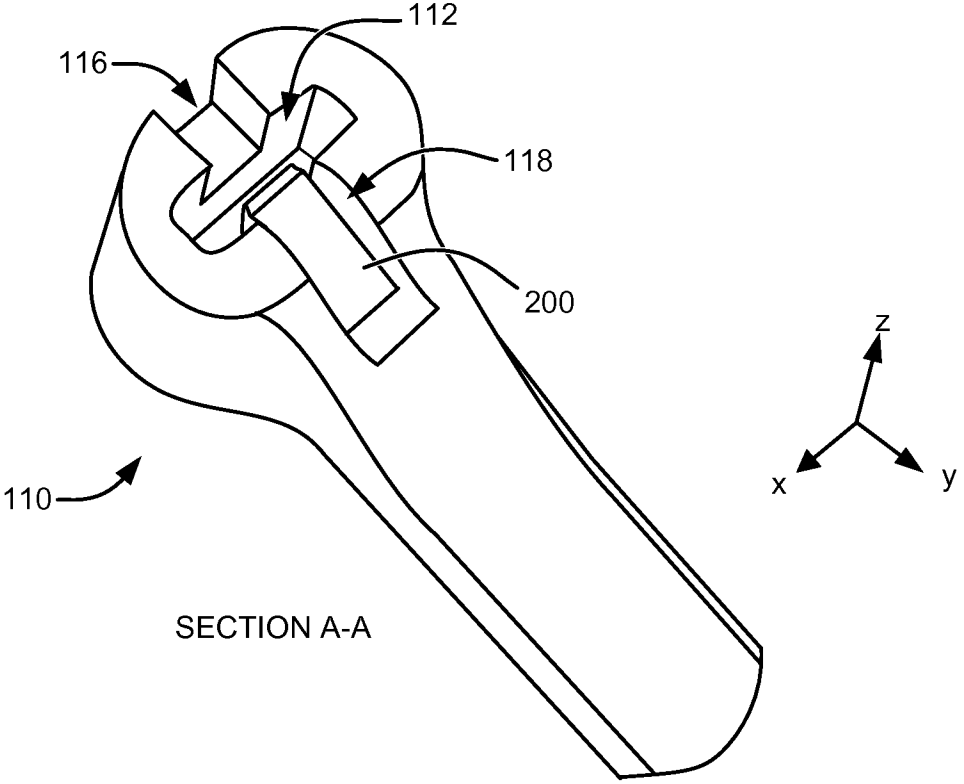
FIG. 2B provides an isometric view of the head section of the cable tie of FIG. 1.

FIGS. 2A and 2B provide a cross-sectional view and an isometric view, respectively, of head section 110 of cable tie 10. Referring collectively to FIGS. 2A and 2B, head section 110 may include a pawl 200 inserted into the head section 110 of band 100. Cable tie 10 may generally include a two-piece construction with band 100 and pawl 200. Pawl 200 may be made of a harder material than that of band 100. For example, pawl 200 may be formed of a high strength metal such as stainless steel, steel, aluminum, or another metal/alloy. Alternatively, pawl 200 may be formed from a hard plastic or a composite material.

Head section 110 may also include an insertion channel 112, a base 114, a pawl insertion cavity 116, and a deflection cavity 118. Insertion channel 112 may include a conduit through the depth (e.g., along the z-axis, as shown in FIG. 2B) of head section 110. Insertion channel 112 may generally be sized to receive tail section 120 and may accommodate a maximum cross-sectional area of tail section 110 (e.g., with a nominal clearance). Base 114 may include a solid section of band 100 material to secure pawl 200. For example, base 114 may include material into which pawl 200 may be embedded. Pawl insertion cavity 116 may include a cut-out of head section 110 that is generally the width (e.g., along the x-axis, as shown in FIG. 2B) of pawl 200 (e.g., with a nominal clearance) to facilitate insertion of pawl 200 into head section 110 during manufacturing. For example, in one implementation, band 100 may be molded from a nylon material and a stainless steel pawl 200 may be injected (or "shot") into base 114 of head section 110 through pawl insertion cavity 116 into the position shown in FIG. 2A. Deflection cavity 118 may include a cut-out of head section 110 that is also generally the width (e.g., along the x-axis, as shown in FIG. 2B) of pawl 200 (e.g., with a nominal clearance) to facilitate deflection of pawl 200 (e.g., caused by insertion of tail section 120 through insertion channel 112).

Figure 3:
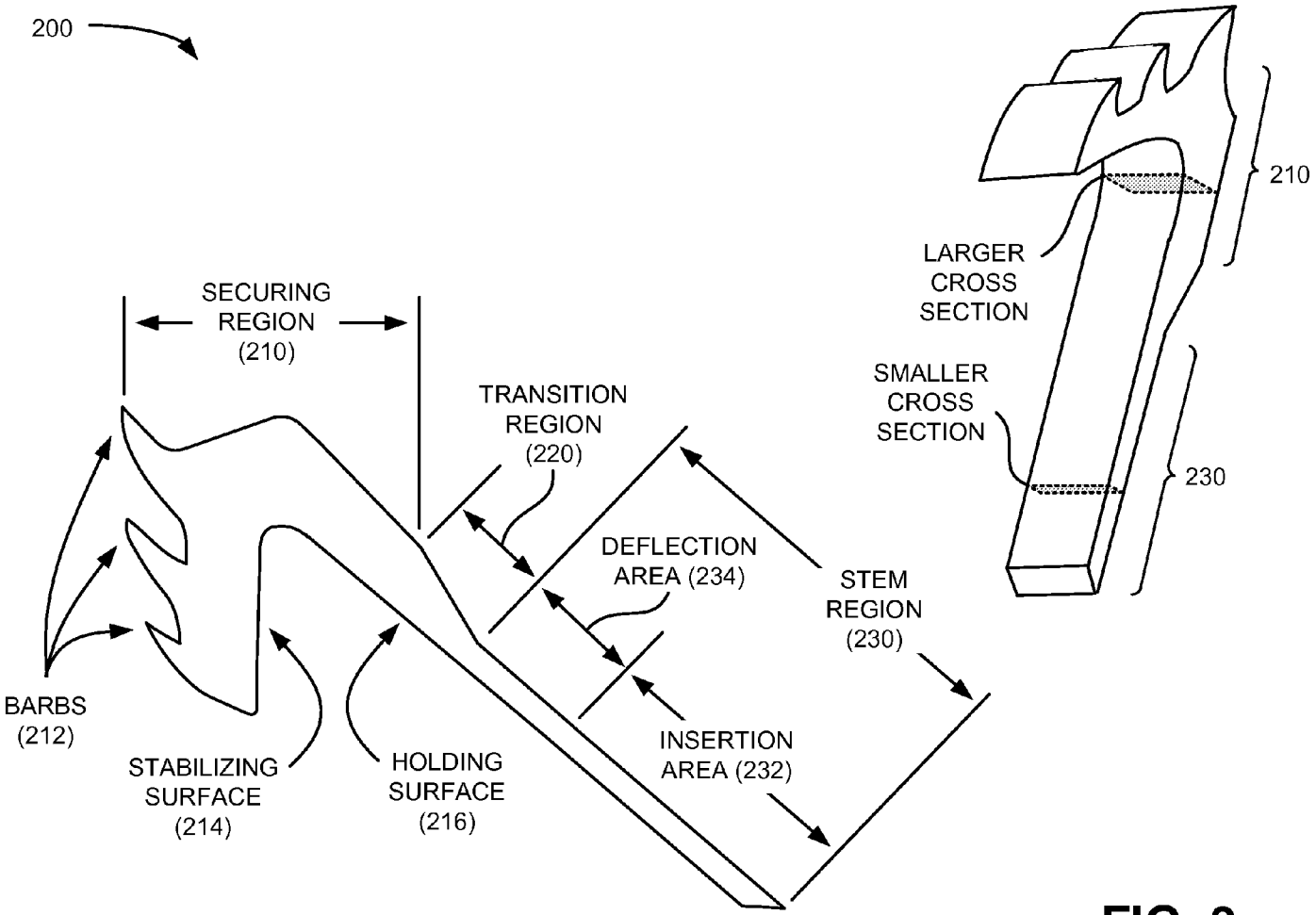
FIG. 3 provides a side view and an isometric view of a pawl of the cable tie of FIG. 1.

FIG. 3 provides a side view and an isometric view of pawl 200. Generally, pawl 200 may include a hook-like shape with multiple sharp barbs. In one implementation, pawl 200 may be manufactured using a stamping and shearing process. In another implementation, pawl 200 may be manufactured using a metal injection molding process. In one implementation as shown in FIG. 3, pawl 200 may include a securing region 210, a transition region 220, and a stem region 230.

Securing region 210 may include one or more barbs 212, a stabilizing surface 214, and a holding surface 216. Barbs 212 extend from a surface facing insertion channel 112 and may be oriented at an angle to permit an object (e.g., tail section 120) to slide past pawl 200 (e.g., through insertion channel 112) in one direction and to engage the object in the opposite direction. While three barbs 212 are shown in FIG. 3, more or fewer barbs may be used in other embodiments. For example, securing region may include one or two barbs.

Securing region 210 may be configured in a hook shape to form stabilizing surface 214 and holding surface 216. In one implementation, stabilizing surface 214 may generally be an opposite surface of the surface including barbs 212. As described further herein, when an extraction load (e.g., applied by tail section 120) is exerted against pawl 200, stabilizing surface 214 may contact an internal surface of head section 110 to prevent bending of pawl 200 and holding surface 216 may contact a different internal surface of head section 110 to oppose tensile forces from tail section 120.

Transition region 220 may include varying cross-sectional areas to provide a gradual transition between the larger cross-sectional area of securing region 210 and a smaller cross-sectional area of stem region 230.

Stem region 230 may include an insertion area 232 and a deflection area 234. Stem region 230 may generally include a smaller cross-sectional area than securing region 210. The smaller cross-sectional area 230 may provide for easier installation (e.g., into base 114) and lower insertion forces (e.g., from tail section 120).

Insertion area 232 may represent the insertion depth of pawl 200 into base 114 (e.g., FIG. 2A). As shown, for example, in FIG. 2A, insertion area 232 may be embedded into base 114 to secure pawl 200 within head section 110. In one implementation, insertion area 232 of stem 230 may be inserted through pawl insertion cavity 116 into base 114 during manufacturing as a subsequent step to an injection molding process for body 100.

Deflection area 234 may represent the area of pawl 200 the may bend (or deflect) during insertion of, for example, tail section 120 into insertion channel 112. As shown, for example, in the isometric figure of FIG. 3, stem region 230 may generally include a smaller cross section than that of securing region 210. The smaller cross section provides for more flex and, thus, a lower required insertion force for tail section 120 into head section 110.

Figure 4:
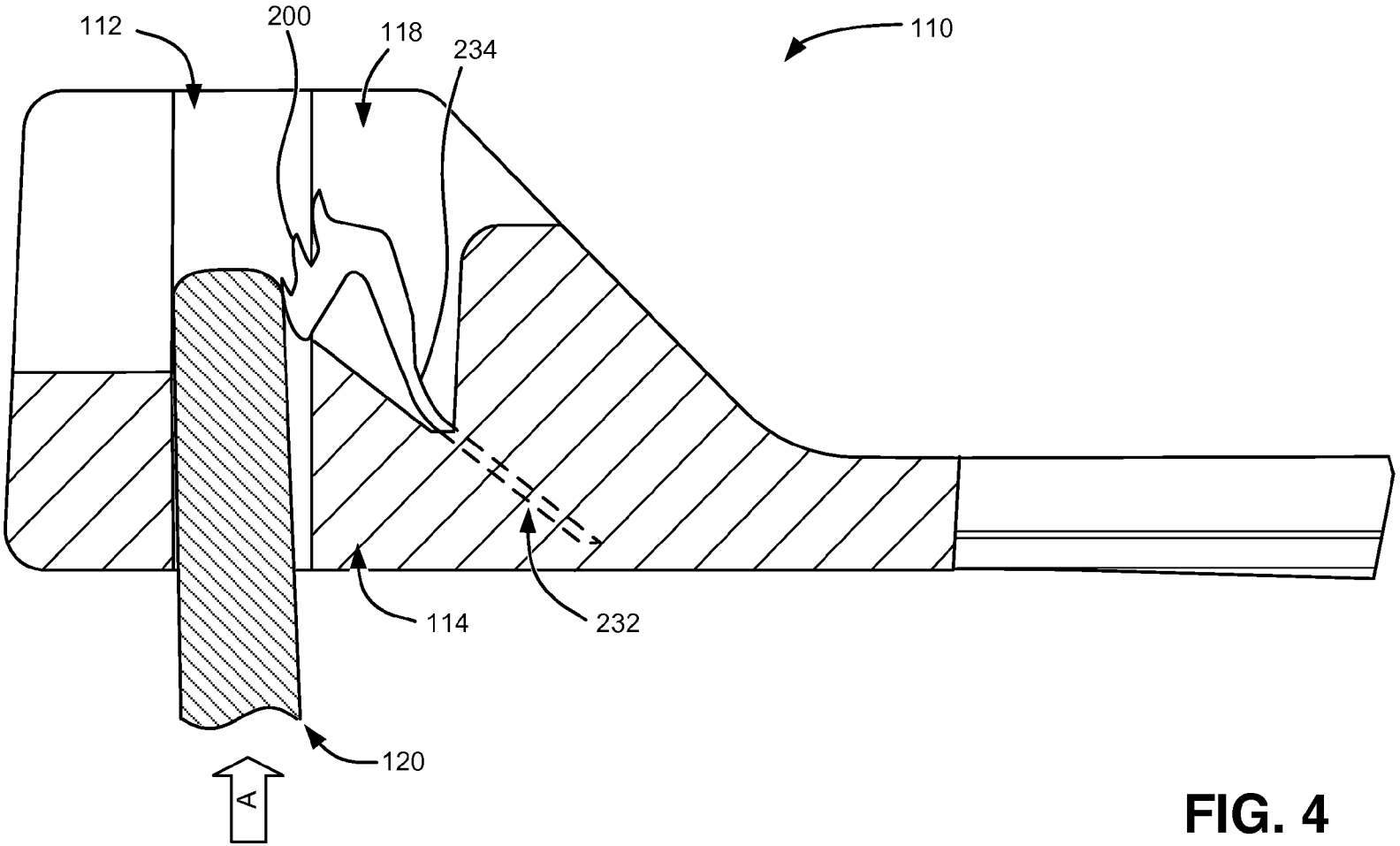
FIGS. 4 and 5 are cross-sectional views of a tail inserted into the head of the cable tie of FIG. 1.
Figure 5:
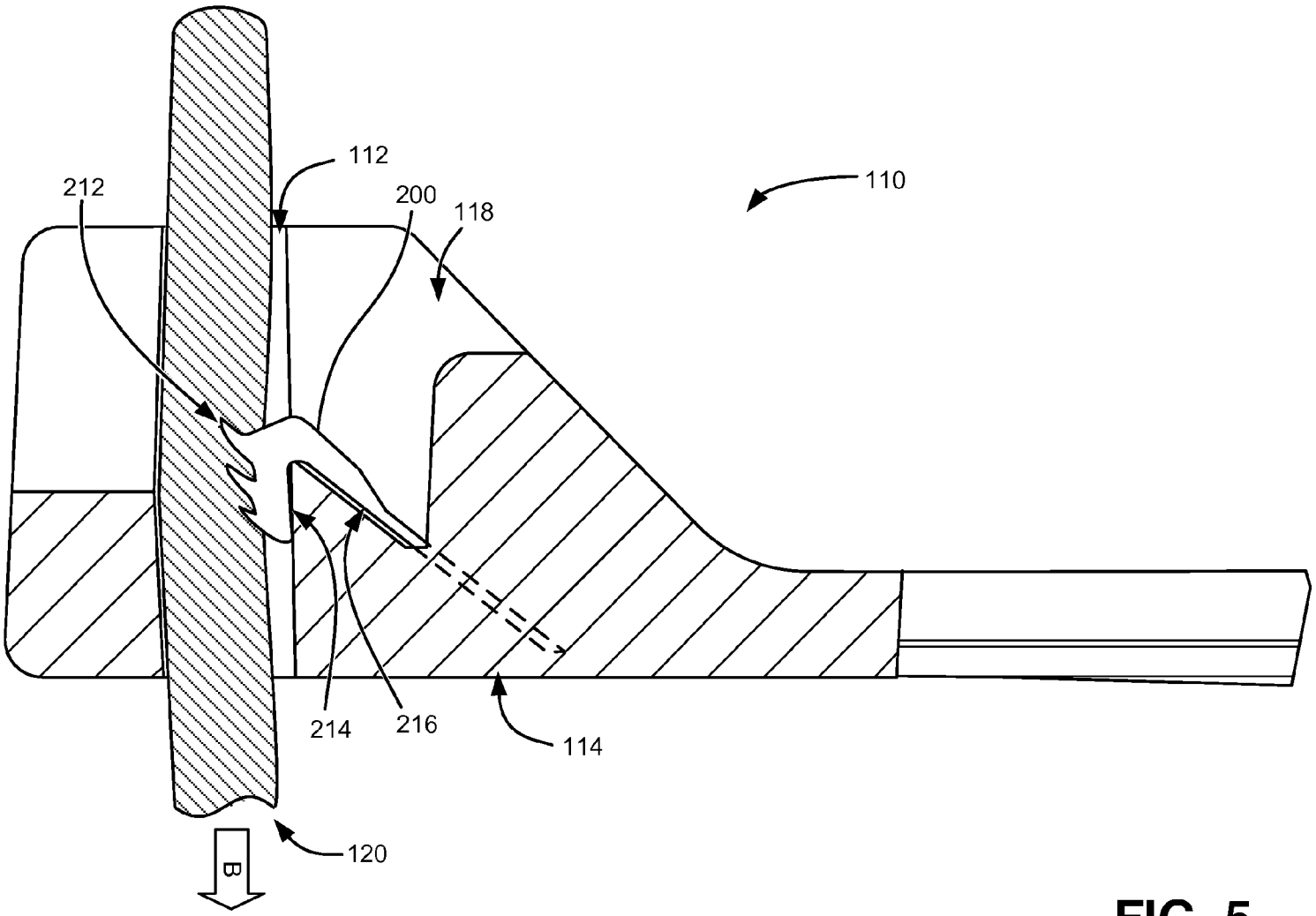

FIGS. 4 and 5 are cross-sectional views of tail section 120 inserted into head section 110 of the cable tie 10. FIG. 4 shows tail section 120 partially inserted into insertion channel 112. As shown in FIG. 4, insertion of tail section 120 in direction "A" may force pawl 200 to deflect into deflection cavity 118. The relatively smaller cross section of stem region 230 (e.g., at deflection area 234) may keep insertion forces low; while the embedding of stem region (e.g., insertion area 232) in base 114 and may cause bending of pawl 200 to be limited to deflection area 234.

Referring to FIG. 5, after tail section 120 is inserted in insertion channel 112 past pawl 200, tail section 120 may be loaded in direction "B." Barbs 212 of pawl 200 may dig into tail section 120 to prevent movement in the load direction. A wall of insertion channel 112 may engage stabilizing surface 214 of pawl 200 to prevent bending of pawl 120. Thus, the load on pawl 200 is primarily in tension (e.g., in the direction of load "B"). A surface of deflection cavity 118 may engage holding surface 216 of pawl 200 to secure the tensile load.

Implementations described herein provide for increased holding force for an installed cable tie. A conventional pawl typically includes a straight strip with a single exposed tip. A failure mode of cable ties with a conventional pawl is excess bending stress on the pawl. Permanent deflection of a conventional pawl from the excess bending stress allows the pawl to disengage from the tail section of the installed cable tie. Increasing the bending strength of the conventional pawl in order to increase the holding force can result in unacceptably high insertion forces for the tail section of the cable tie.

Implementations described herein may increase the holding force of the cable tie by changing the load on the pawl so that the load is in tension instead of bending. A smaller cross-sectional area in the stem region of the pawl allows for relatively low insertion forces; while the larger cross-sectional area in the securing region of the pawl provides greater holding strength for the tensile load. Furthermore, implementations described herein may include multiple barbs on the pawl to provide increased grip on the tail section of the installed cable tie.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A cable tie, comprising:

a pawl of a first material, the pawl including a stem region and a securing region, wherein the securing region includes at least one barb and a stabilizing surface opposite the at least one barb; and a band of a second material, different than the first material, the band including a head section and a tail section, the head section including:

a base section into which at least a portion of the stem region of the pawl is inserted, and an insertion channel to receive the tail section, wherein at least a portion of the pawl extends into the insertion channel, wherein, when a load is exerted to remove the tail section from the insertion channel, the at least one barb engages the tail section and the stabilizing surface contacts a side of the insertion channel to prevent bending of the pawl.

2. The cable tie of claim 1, wherein the stem region includes a first cross-sectional area and wherein the securing region includes a second cross sectional area that is larger than the first cross-sectional area.

3. The cable tie of claim 1, wherein the head section further comprises:

a deflection cavity to permit deflection of the pawl when the tail section is inserted through the insertion channel.

4. The cable tie of claim 1, wherein the first material comprises one of a metal or an alloy and wherein the second material comprises nylon.

5. The cable tie of claim 1, wherein the pawl further comprises a holding surface, different from the stabilizing surface, to resist the load exerted to remove the tail section.

6. The cable tie of claim 1, wherein the securing region includes two or more barbs.

7. The cable tie of claim 1, wherein the head section further includes a pawl insertion cavity, and wherein the stem is inserted into the base section through the pawl insertion cavity as a subsequent step to an injection molding process for the band.

8. A pawl for a cable tie, comprising:

an embedded region configured to be embedded into a base of the cable tie;

a deflection region, adjacent to the embedded region, to allow bending of the pawl in response to an applied force from an object contacting the barb when the object advances in a first direction within a channel of the cable tie; and a hook-shaped securing region including a barbed surface on the outside of the hooked-shape securing region includes at least one barb configured to engage the object contacting the barb when the embedded region is embedded into the base of the cable tie and when the object advances in a second direction opposite the first direction within the channel, and a stabilizing surface, generally opposite the barbed surface, configured to contact a side of the channel to prevent bending of the pawl when the embedded region is embedded into the base of the cable tie and when force is applied from the object in the second direction.

9. The pawl of claim 8, wherein the pawl comprises stainless steel.

10. The pawl of claim 8, wherein the deflection region includes a first cross-sectional area and wherein the securing region includes a second cross sectional area that is larger than the first cross-sectional area.

11. The pawl of claim 10, wherein the embedded region and the deflection region include the same cross-sectional area.

12. The pawl of claim 8, wherein the securing region includes two or more barbs.

13. The pawl of claim 8, wherein the hook-shaped securing region further comprises a holding surface, on the inside of the hooked-shape securing region and different from the stabilizing surface, configured to contact a side of the deflection cavity of the cable tie, when the embedded region is embedded into the base of the cable tie, to resist the force applied from the object in the second direction.

14. The pawl of claim 8, wherein the pawl is formed using one or more of:

a stamping process, a shearing process, and a metal injection molding process.

15. A cable tie head, comprising:

a pawl including a stem region and a securing region, wherein the securing region includes at least one barb and a stabilizing surface opposite the at least one barb, and wherein the pawl includes a first material;

a base section to receive at least a portion of the stem region, wherein the base section includes a second material that is different than the first material;

an insertion channel to receive a strap for the cable tie, wherein at least a portion of the pawl extends into the insertion channel; and wherein, when an extraction load is applied to remove the strap from the insertion channel, the at least one barb engages the strap and the stabilizing surface contacts a side of the insertion channel to prevent bending of the pawl.

16. The cable tie head of claim 15, wherein the stem region includes a first cross-sectional area and wherein the securing region includes a second cross sectional area that is larger than the first cross-sectional area.

17. The cable tie head of claim 15, further comprising:

a deflection cavity to permit deflection of the pawl when an insertion load is applied through the insertion channel.

18. The cable tie head of claim 17, wherein the pawl further comprises a holding surface, different from the stabilizing surface, to engage a side of the deflection cavity to resist the extraction load.

19. The cable tie head of claim 15, wherein the first material is harder than the second material.

20. The cable tie head of claim 19, wherein the first material comprises stainless steel and wherein the second material comprises nylon.

* * * * *